US006234451B1

(12) United States Patent
Baron

(10) Patent No.: US 6,234,451 B1
(45) Date of Patent: May 22, 2001

(54) LEVELING OF LEG SUPPORTED DEVICES

(76) Inventor: Mike Baron, 20 Circle Dr., Meredith, NH (US) 03253

( * ) Notice: Subject to any disclaimer, the term of this patent is extended or adjusted under 35 U.S.C. 154(b) by 0 days.

(21) Appl. No.: 09/332,621

(22) Filed: Jun. 14, 1999

(51) Int. Cl.[7] ..... B66F 3/22

(52) U.S. Cl. ..... 254/122; 254/126; 254/DIG. 1; 254/DIG. 4

(58) Field of Search ..... 254/88, 100, DIG. 1, 254/DIG. 4, 122, 126–133

(56) References Cited

U.S. PATENT DOCUMENTS 3,493,209 * 2/1970 Brammer ..... 254/DIG. 1
4,330,104 * 5/1982 Klok ..... 254/DIG. 4
4,749,169 * 6/1988 Pickles ..... 254/122
4,834,339 * 5/1989 Clarke ..... 254/DIG. 1
4,882,887 * 11/1989 Giles et al. ..... 254/DIG. 4
5,215,287 * 6/1993 Leski ..... 254/122
5,898,022 * 4/1999 Maples ..... 508/113
5,915,672 * 6/1999 Dickey ..... 254/DIG. 1

FOREIGN PATENT DOCUMENTS

1034571 * 1/1965 (GB) ..... 254/88

* cited by examiner

*Primary Examiner*—Robert C. Watson
(74) *Attorney, Agent, or Firm*—George E. Kersey, Esq.

(57) ABSTRACT

This invention relates to the leveling of devices, and more particularly, to the leveling of leg supported devices, such as pool and billiard tables. In accomplishing the foregoing and related objects, the invention provides a scissors mechanism overlying a special base and underlying a special rubber-padded saddle.

6 Claims, 3 Drawing Sheets

LEVELING OF LEG SUPPORTED DEVICES

This invention relates to the leveling of devices, and more particularly, to the leveling of leg supported devices, such as pool and billiard tables.

For many devices it is desirable to have a level upper surface. In the case of tables for the playing of billiards and pool, it is necessary to have a playing surface that is as level as possible.

For stability, pool table are relatively massive and contain a suitable stabilizing material, such as slate. Because of the weight of the slate in pool tables, it is difficult to move the tables when there is a need to produce a level playing surface.

It has been standard practice to use hydraulic jacks when attempting to provide a level surface for pool tables and similar devices. These jacks have not operated satisfactorily. When it becomes necessary to level a pool table, there has to be some way of lifting it in order to add or remove shims, which are thin pieces of wood, typically measuring 4 inches by 4 inches by 1/16 inch, or other material used for filling space during a leveling operation.

Preliminary leveling takes place before installing slate on the table. After the slate is installed, it is necessary to do a further leveling, which is a fine-tuning operation. Commonly, the fine-tuning is done by using knees, the back or a hydraulic jack in connection with a long wooden lever and a fulcrum. This is very awkward procedure because the operator tries to hold the lever down while placing or removing a shim the other hand. Although hydraulic jacks have been used for many years, they present a number of problems. In the first such jacks are very heavy and difficult to maneuver properly. Another problem is that hydraulic jacks leak. If a table to be leveled is in finished premises, hydraulic leakage needs to be avoided. Otherwise, fluid leaks around the edges of the jack at its seals and has a way of getting into new carpeting.

Moreover, the leaking oil gets on the fingers of the operator, and on the table itself, creating a mess. There is still another problem with hydraulic jacks, particularly in cold regions, such as New England. If the jack is in a truck when the temperature falls, the jack will not operate properly. The jack could be removed from the truck, and brought inside for warm-up, but that represents a lot of extra effort, particularly for very heavy devices. In fact, once the jack has been exposed to low temperatures. it is virtually useless until it defrosts, which can take up to several hours.

Accordingly, it is an object of the invention to facilitate the leveling of devices, and more particularly, to the leveling of leg supported devices, such as pool table.

Another object of the invention is to achieve level upper surface. A related object is to provide playing surfaces that are as level as possible, particularly in the case of tables for the playing of billiards and pool.

A further object of the invention is to achieve leveling where, for stability, tables are relatively massive. A related object is to achieve leveling for tables that contain a suitable stabilizing material, such as slate.

Yet another object of the invention, because of the weight of the slate in pool tables, is simplify the movement of tables when there is a need to produce a level playing surface.

Still another object is to avoid the need for hydraulic jacks when attempting to provide a level surface for pool tables and similar devices. A related object is to provide a simplified way of lifting in order to add or remove shims, during a leveling operation.

An additional object of the invention is to simplify leveling after installing slate on the table. A related object is to achieve expedited fine-tuning. Another related object is to avoid the use of knees, the back or a hydraulic jack.

A further object is to avoid the need for heavy jacks which are difficult to maneuver properly, and to avoid the leakage commonly associated with hydraulic jacks, particularly where a table is to be leveled in finished premises.

Hydraulic leakage needs to be avoided because the fluid that leaks around the edges of the jack at the seals has a way of getting into new carpeting, on the fingers of the operator, and on the table itself, creating a mess.

A yet further object is to avoid the problems that occur with hydraulic jacks, particularly in cold regions, such as New England. A related object is to avoid the need for inside warm-up and the extra effort that requires, particularly for very heavy devices. Another related object is to avoid the need for defrosting once the jack has been exposed to low temperatures, and the time required, up to several hours.

SUMMARY OF THE INEVNTION

In accomplishing the foregoing and related objects, the invention provides a scissors mechanism overlying a special base and underlying a special rubber-padded saddle.

The mechanism can be used with blocks that are properly located to avoid kick out. The scissors mechanism can be permanently or removably secured to the base, with welding being one form of permanent attachment. A saddle or plate at the top of the mechanism is positioned beneath the device to leveled, such as at the edge of a pool table.

The invention works well, saves a lot of work, and illustratively have a lift range of from about 11 to about 21 inches. The entire mechanism can weigh slightly less than 10 lbs so that it is very maneuverable and easy to carry and yet be rugged enough to do repeated lifting of 5 to 700 pounds on a daily basis.

The mechanism also is very clean, requiring only a minute amount of lubricant for appropriate scissors operation.

In accordance with one aspect of the invention the minute lubricant can take the form of petroleum jelly, such as that sold and marketed under the trade name "Vaseline" with a minute addition of graphite, for the scissor pins.

A unique pin can be added to the handle to make it easier to use.

In accordance with a further aspect of the invention a handle for operating the scissors mechanism can be adapted to provide ease of rotation and ease of handling in operation.

Apparatus of the invention for the elevation of objects comprises a base; a scissors mechanism; means for mounting the scissors mechanism on the base; an engagement member; and means for mounting the engagement member on the mechanism.

The scissors mechanism can be fixedly or removably mounted on the base, which can include a handle, and the engagement member, which can be a flat plate, can be fixedly or movably mounted on the mechanism.

In a method of the invention for leveling a surface above a support,the steps include placing a scissors mechanism below the surface; the scissors mechanism is elevated until it engages the support for the surface; the scissors mechanism is incrementally elevated after engagement with said support until a degree of leveling is achieved for said surface.

Where the surface is leg supported, a further step is to insert a shim under one support leg after desired leveling has been obtained, with the leg elevated above its original contact.

The method further includes the step of mounting an engagement member at the top of said mechanism for edge positioning engagement of a device to be leveled, and a support stand is positioned beneath the scissors mechanism to allow leveling of surfaces having a displacement in excess of the maximum elevation of the scissors mechanism without the support stand.

In the method the surface is leg-supported and a further step is to place the scissors mechanism between a first set of adjoining legs, and/or between a second set of adjoining legs.

A lubricant in the form of petroleum jelly, with the addition of graphite, can be applied to pivot pins of the scissors mechanism.

Apparatus of the invention for the leveling of surfaces includes a pyramidal base having a apex; a scissors mechanism mounted on the apex; and an engagement member mounted on the scissors mechanism. The pyramidal base has legs that converge to a neck of said scissors mechanism, with the legs base-connected by rods.

The scissors mechanism has lower arms pivotally joined to a neck; intermediate arms pivotally connected to each other and the lower arms; a threaded elevating screw extends through the position of each connection of said intermediate and lower arms; upper arms are pivotally connected to the intermediate arms; and the engagement member, such as a plate. is connected to the upper arms.

DESCRIPTION OF THE DRAWINGS

Other aspects of the invention will become apparent after considering several illustrative embodiments of the invention, taken in conjunction with the drawings in which.

DETAILED DESCRIPTION

Figure 1:
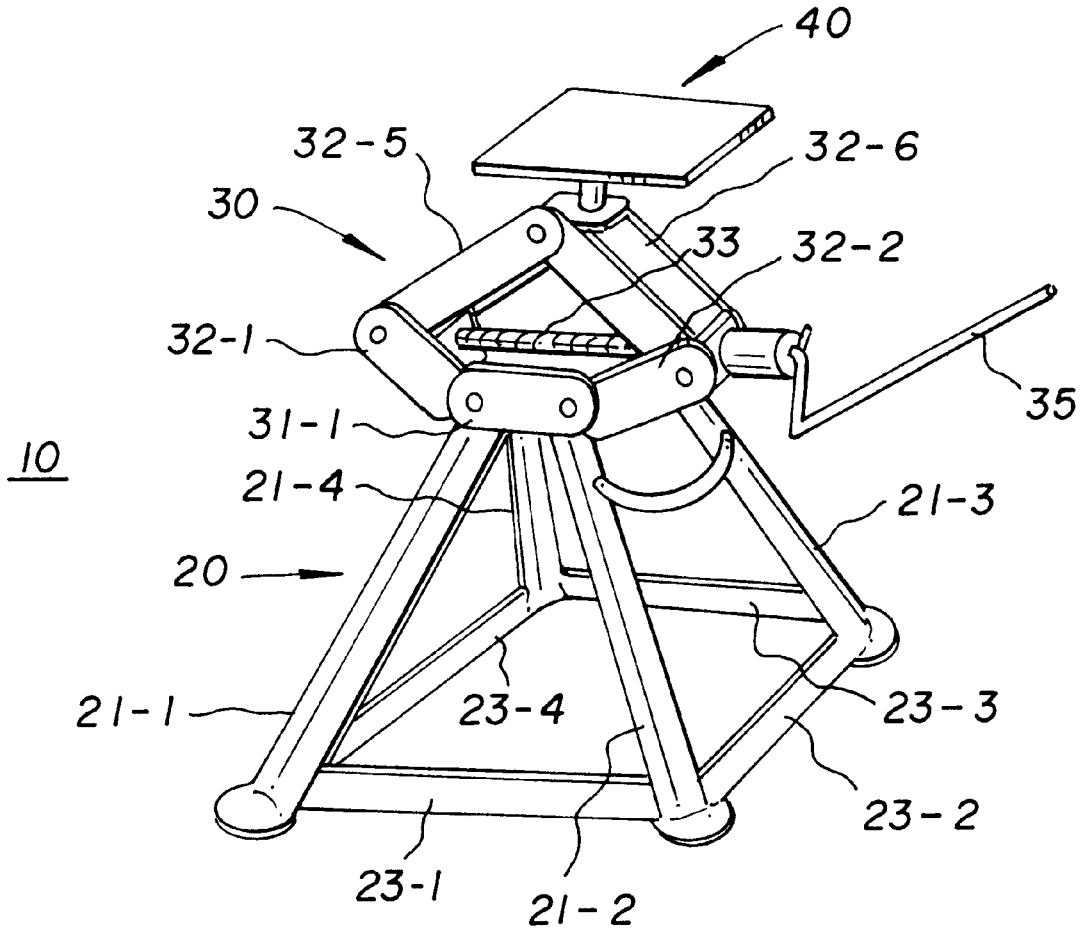
FIG. 1 is a perspective view of a leveling device in accordance with the invention.

With reference to the drawings, the leveling device 10 of the invention shown in FIG. 1 is formed by a pyramidal base 20 for a scissors mechanism 30 mounting a support 40.

The pyramidal base 20 includes legs 21-1 through 21-4 that converge from base rods 22-1 through 22-4 to a neck 31 of the scissors mechanism 30. For added stability, the legs 21 are base-connected by rods 23. Thus, leg 21-1 is base-connected to leg 21-2 by rod 23-1. Similarly, leg 21-2 is connected to leg 21-3 by rod 23-2. Leg 21-3 is connected to leg 21-4 by rod 23-3, and leg 21-4 is connected to Leg 21-1 by rod 23-4. The pyramidal base 20 is advantageously fixed to the scissors mechanism 30 but can be removable if it is too high to fit under a table that needs levelling, where the clearance, for example, can be as little as 12 inches. The invention overcome this problem by suitably lowering the top of the base and using a special design.

Figure 2:
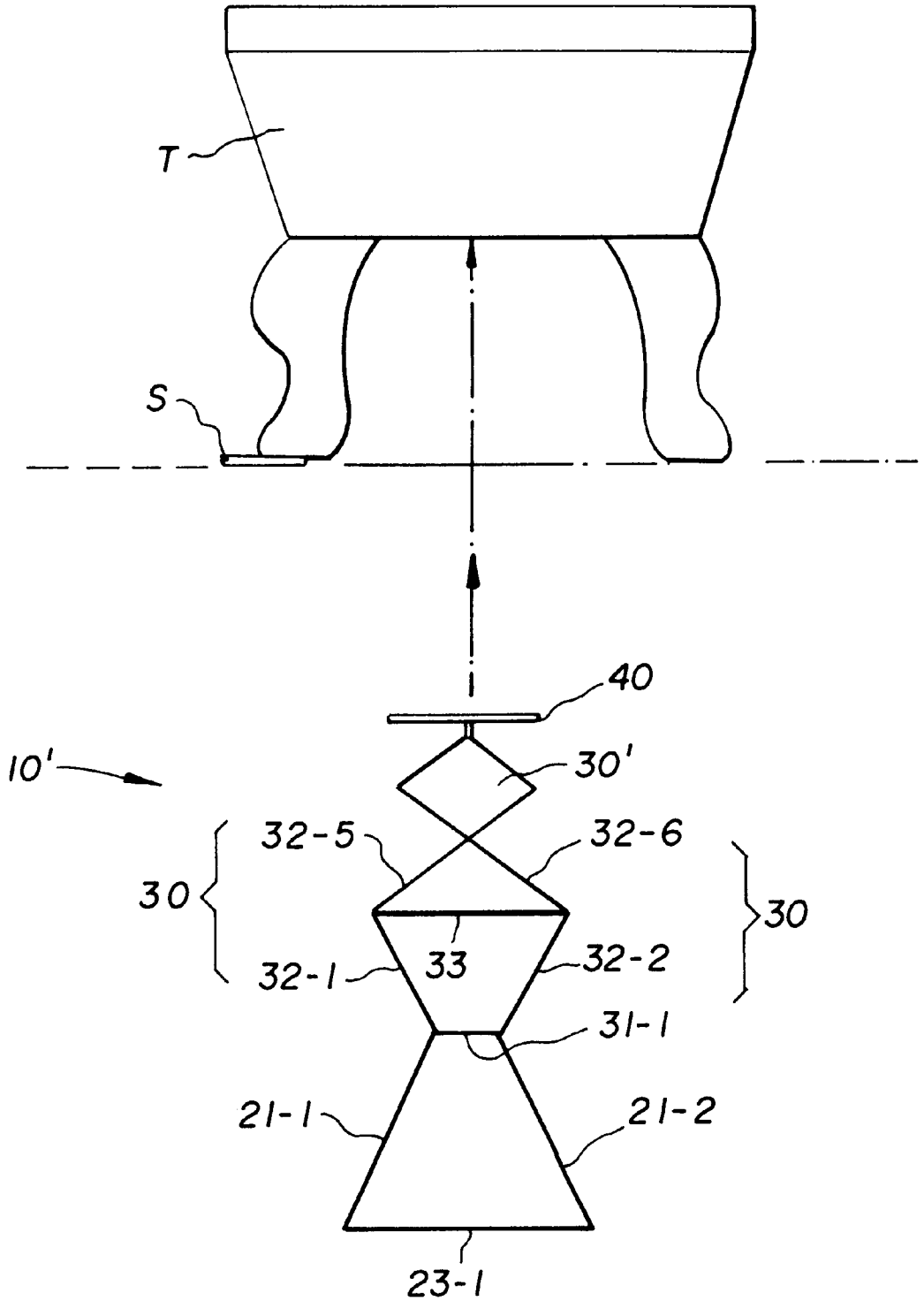
FIG. 2 is a perspective view showing the leveling device of FIG. 1 being used in the end leveling of a leg-supported billiard table.

Alternatively, the low clearance problem can be overcome by lowering the base height. In cases where the clearance between the object to be levelled and the floor is too high, the scissors mechanism 30 can be supplemented by a second scissors mechanism 30' as shown in FIG. 2. The use of a double-tier scissors design give an increased lift range so that the shorter base does not hinder the ability of the invention to work on tables with a relatively high frame. Both coin operated and taller frame tables become workable.

The scissors mechanism 30 of FIG. 1 has lower arms 32-1 and 32-2 pivotally joined to the neck member 31-1. It will be appreciated that opposite side arms 32-3 and 32-4 (not visible in FIG. 1) are pivotally connected to neck member 31-2 also not visible in FIG. 1. Intermediate arms 32-5 and 32-6 are pivotally connected at the distal ends of respective arms 32-1 and 32-2. Again, there are opposite intermediate arms 32-7 and 32-8 connected to arms 32-3 and 32-4. The pivot between arms 32-2 and 32-4 receives a threaded elevating screw 33 which extends through the opposite pivot joining the arms 32-2 and 32-4. Upper arms 32-9 and 32-10 are pivotally connected to the distal ends of the arms 32-5 and 32-6 and are in turn pivotally secured to the support plate or saddle 40, at the top of the scissors mechanism that can measure approximately 9"×2 ½".

In the employment of the invention to level a surface such as that of a billiard table T in FIG. 2, the device 10', which has a second scissors mechanism 30' superimposed upon the underlying scissors mechanism 30, is placed under the edge of the table T. The crank handle 35 of the scissors mechanism 30 is rotated to bring the opposing pivots together and elevate the arms, as shown in FIG. 2 so that the support plate 40 engages the lower edge of the table. Further rotation of the screw using the handle 35 achieves the desired leveling of the table T which is then shimmed, for example, by the shim S shown in FIG. 2 to secure the level position obtained by the use of the device 10.

It will be noted that to facilitate the position of the device 10 below the structure to be leveled the pyramidal base 20 includes an arcuate handle that interconnects opposing converging sides of the base as shown in FIGS. 1 and 2.

Figure 3:
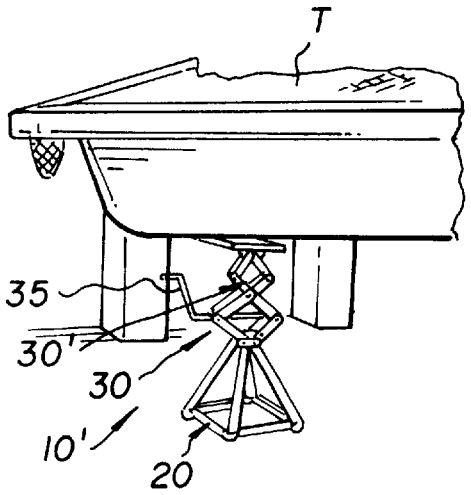
FIG. 3 is a perspective view showing the leveling device of FIG. 2 being used in the side leveling of a leg-supported billiard table.

As shown in FIG. 3, which is a perspective view of the leveling device 10' of FIG. 2 being used in the side leveling of a leg-supported billiard table, a leg of the table has been raised several inches on the wide side to allow the placement or removal of shims under the leg. It will be appreciated that other legs may be raised to allow placement or removal of shims in order to achieve the desired leveling.

Figure 4A:
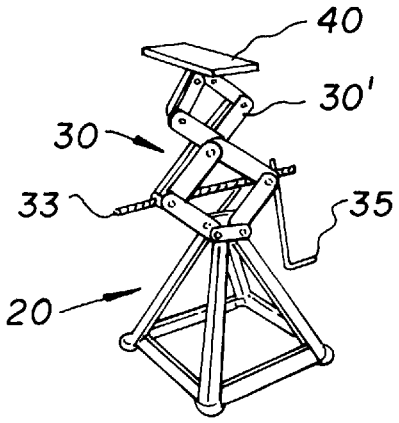
FIG. 4A is a perspective view showing the leveling device of FIG. 2 partially extended.
Figure 4B:
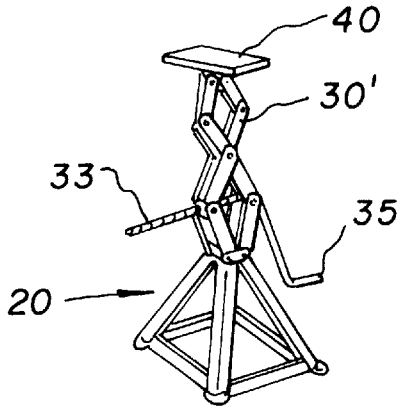
FIG. 4B is a perspective view showing the leveling device of FIG. 2 fully extended.

As shown in FIG. 4A, which is a perspective view of the leveling device 10' of FIG. 2, the device has been partially extended by clock-wise rotation of the elevating screw handle. Upon further rotation of the handle, the leveling device of FIG. 2 becomes fully extended as indicated in FIG. 4B.

Figure 4C:
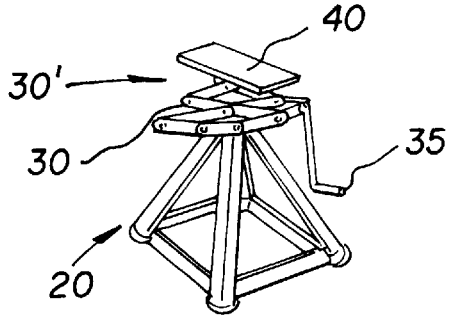
FIG. 4C is a perspective view showing the leveling device of FIG. 2 in its fully closed position.

When the leveling operation has been completed, the leveling screw handle is rotated in a counter-clockwise direction to bring the device 10' of FIG. 4C to its fully closed position.

It will be appreciated that the foregoing description is illustrative only and that other modifications and adaptations of the invention will be readily apparent to those of ordinary skill in the art.

What is claimed:

1. Apparatus for the elevation of objects comprising a base having converging sides and an arcuate handle interconnecting opposing ones of said converging sides; a scissors mechanism;

means for detachably mounting said scissors mechanism on said base;

an engagement member; and means for mounting said engagement member on said mechanism.

2. Apparatus as defined in claim 1 wherein said scissors mechanism has a neck connected to said base.

3. Apparatus as defined in claim 1 wherein said engagement member is mounted on said mechanism and proportioned to engage a table.

4. Apparatus as defined in claim 3 wherein said engagement member is a completely flat plate.

5. Apparatus as defined in claim 1 wherein said base is pyramidal and supplemented by a second scissors mechanism.

6. Apparatus as defined in claim 1 wherein said mechanism has pivot pins and lubricant in the form of petroleum jelly, with graphite, is applied to said pivot pins of said scissors mechanism.

* * * * *